US005313508A

United States Patent [19]

Ditman et al.

[11] Patent Number: 5,313,508

[45] Date of Patent: May 17, 1994

[54] METHOD OF AND APPARATUS FOR DETECTING AND COUNTING ARTICLES

[75] Inventors: John L. Ditman, Buckeystown; David J. Holmes, III, Annapolis, both of Md.

[73] Assignee: Batching Systems, Inc., Owings, Md.

[21] Appl. No.: 812,010

[22] Filed: Dec. 23, 1991

[51] Int. Cl.[5] ..... G06M 7/00

[52] U.S. Cl. ..... 377/6; 377/53; 250/221; 250/206.1; 307/311

[58] Field of Search ..... 307/311; 377/6, 53; 250/226, 221, 206.1

[56] References Cited

U.S. PATENT DOCUMENTS

| | | | |
|---|---|---|---|
| 3,618,819 | 11/1971 | Blackburn et al. | 221/2 |
| 3,692,980 | 9/1972 | Getker et al. | 377/6 |
| 4,127,766 | 11/1978 | Thayer | 377/6 |
| 4,144,449 | 3/1979 | Funk et al. | 250/221 |
| 4,272,189 | 6/1981 | Bailey et al. | 356/28 |
| 4,313,109 | 1/1982 | Funk et al. | 341/5 |
| 4,364,035 | 12/1982 | Kirsch | 250/226 |
| 4,544,841 | 10/1985 | Bright et al. | 250/221 |
| 4,628,520 | 12/1986 | Menger | 377/6 |
| 4,651,023 | 3/1987 | Parsonage | 307/311 |
| 4,675,520 | 6/1987 | Harrsen et al. | 250/222.2 |
| 4,699,273 | 10/1987 | Suggi-Liverani et al. | 209/580 |
| 4,763,903 | 8/1988 | Goodwin et al. | 273/371 |
| 4,822,999 | 4/1989 | Parr | 250/226 |
| 4,919,534 | 4/1990 | Reed | 356/73 |
| 4,982,412 | 1/1991 | Gross | 377/6 |
| 5,004,908 | 4/1991 | Nakamura | 250/221 |

*Primary Examiner*—John S. Heyman
*Attorney, Agent, or Firm*—Nies, Kurz, Bergert & Tamburro

[57] ABSTRACT

A method and apparatus for counting irregularly-shaped articles. A pair of light sources are provided at a sensing plane through which articles to be counted pass. Each of the light sources emits a light beam that is at an angle to the other light beam, such as an angle of about 90°. Corresponding light sensors are positioned opposite the respective light sources to receive the light signals as the articles pass through the sensing plane. A time division multiplex circuit is provided to alternately operate the light sources, and the outputs from the respective light detectors are summed to provide a unitary signal that is provided to a counter to maintain a count of the number of articles passing through the sensing plane. The system provides combined output signals that are substantially independent of the orientation of the article at the sensing plane.

8 Claims, 6 Drawing Sheets

METHOD OF AND APPARATUS FOR DETECTING AND COUNTING ARTICLES

BACKGROUND OF THE INVENTION

1. Field of the Invention

The present invention relates to a method of and an apparatus for counting articles as they are carried along or allowed to fall through a passageway across which a light beam extends and through which the articles are constrained to pass. More particularly, the present invention is directed to a method of and an apparatus for detecting articles by providing a pair of crossed light beams at a sensing plane in the passageway, to permit the detection of articles independent of their orientation relative to the respective light sources.

2. Description of the Related Art

Devices for counting articles are broadly known. For example, in U.S. Pat. No. 3,618,819, which issued Nov. 9, 1971, to Charles M. Blackburn and John L. Ditman there is disclosed an electronic counting apparatus wherein the interruption of a thin, narrow beam of light that extends across the passageway through which articles pass is sensed by a solar cell positioned opposite the source of the light beam. The length of the output pulse from the solar cell is utilized to determine that an article has passed the sensing plane.

In U.S. Pat. No. 4,982,412, which issued Jan. 1, 1991, to Barry M. Gross, there is disclosed an apparatus and a method for counting a plurality of similar articles. That patent discloses a counter in the form of a light source and a photoelectric cell, the cell sensing interruption of the light beam. The device provides an output when the light sensor output falls below a predetermined level. The device is so configured that a predetermined time interval can be set for the duration of the detector output signal, in order to avoid overcounting.

In U.S. Pat. No. 4,675,520, which issued Jun. 23, 1987, to Jan Harrsen et al., there is disclosed a counter for counting small particles, such as seeds, by providing crossing light beams that are operated in sequential scanning cycles to provide pulses in two perpendicular directions, the pulses being multiplied together to provide a unitary output signal indicative of the presence of a particle to be counted.

Although the prior art has disclosed the provision of counting arrangements for counting articles that pass through a sensing plane and thereby interrupt beams of light, most of the prior art devices are directed to sensing symmetrical objects that provide similar detector outputs in each of two different directions.

It is an object of the present invention to overcome the deficiencies of the prior art devices and to provide an article sensing and counting method and apparatus for accurately counting non-symmetrical articles.

It is another object of the present invention to provide an article counting apparatus that is relatively simple and inexpensive to manufacture.

SUMMARY OF THE INVENTION

Briefly stated, in accordance with one aspect of the present invention, a method of detecting and counting articles is provided. The articles travel along or fall through a passageway, and a pair of light sources are positioned at one point in the passageway and are oriented to provide crossing light beams that extend across the passageway. A pair of light detectors is so positioned opposite respective ones of the light sources so that the light from each light source is received by only one of the detectors. Each detector provides an individual output signal that is representative of a change in the amount of light reaching the detector when an article to be counted passes through the light beam provided by the light source. The resulting individual output signals from each light detector are added together to provide a combined output signal, and provided the output signal has greater than a predetermined magnitude and greater than a predetermined time duration, the respective signals are counted to provide an accurate count of the number of articles that have passed along the passageway and through the sensing plane.

In accordance with another aspect of the present invention, apparatus for detecting and counting articles is provided, the apparatus including a pair of angularly positioned light sources to provide crossing light beams that extend across a passageway through which articles to be sensed are conveyed. A pair of light detectors are positioned opposite respective ones of the light sources. The apparatus is arranged to eliminate spurious detector outputs that could result from reflection from an article to be counted of light from one of the light sources onto the detector associated with the other light source.

DESCRIPTION OF THE PREFERRED EMBODIMENTS

Figure 2:
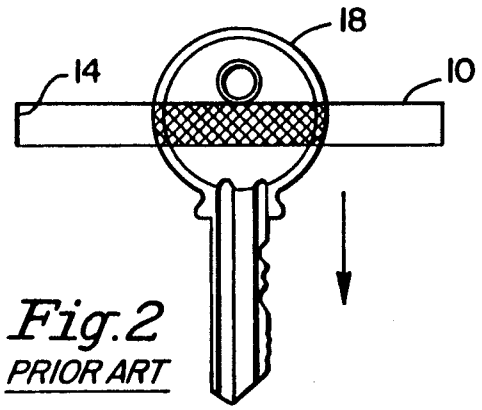
Fig. 2 PRIOR ART
FIG. 2 is a side view looking across the passageway and in the direction of the sensing plane of FIG. 1.

Referring now to the drawings, and particularly to FIGS. 1 through 4 thereof, there is shown a prior art article sensing station including a sensing plane 10 shown in exaggerated thickness form and defined substantially by an elongated light beam that emanates from an elongated light source 12. The light beam is so oriented as to pass perpendicularly across an article passageway 14 and to substantially completely sweep across the passageway to impinge upon the surf ace of an elongated light detector 16 positioned on the opposite side of the passageway from light source 12. Light detector 16 can be, for example, a solar cell.

Figure 4:
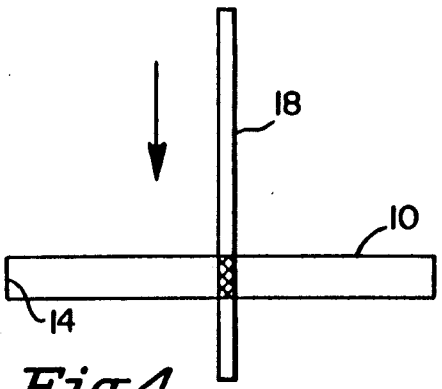
Fig. 4 PRIOR ART
FIG. 4 is a side view similar to FIG. 2, but with the article oriented as shown in FIG. 3.

An article 18, shown in the drawings for purposes of illustration in the form of a key for opening a lock, passes along passageway 14 in the direction shown by the arrow in FIGS. 2 and 4 as oriented relative to the light source and detector so that only the thickness dimension of the key is aligned with the direction of the light beam. As article 18 travels along passageway 14 it passes through sensing plane 10 to partially interrupt the light beam emanating from light source 12, and that interruption affects the amount of light impinging on detector 16 to thereby affect the strength of the output signal from detector 16. In the prior art device as shown in FIGS. 1 through 4, only a single light source 12 and a single light detector 16 are provided.

Figure 3:
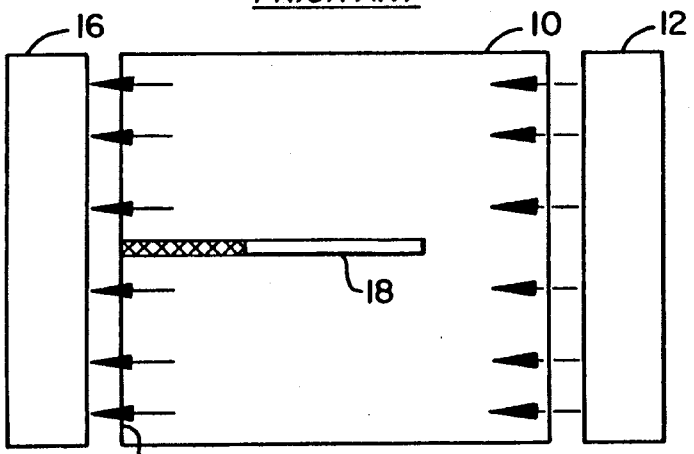
Fig. 3 PRIOR ART
FIG. 3 is an elevational view similar to FIG. 1, but showing the article to be sensed in a different orientation relative to the light source and light detector.

As will be appreciated, for irregularly-shaped articles that pass through sensing plane 10 and that interrupt the light beam passing across sensing plane 10 from light source 12 to light detector 16, the magnitude of the output signal from detector 16 is dependent upon the orientation relative to the light beam of the article that is to be sensed. Thus, a substantially flat article, such as key 18, blocks only a small quantity of light from light source 12 when the key is oriented so that its thickness dimension is perpendicular to the direction of the light beam, as shown in FIGS. 1 and 2, as compared with its orientation as shown in FIGS. 3 and 4, in which its thickness dimension is parallel with the direction of the light beam.

Figure 1:
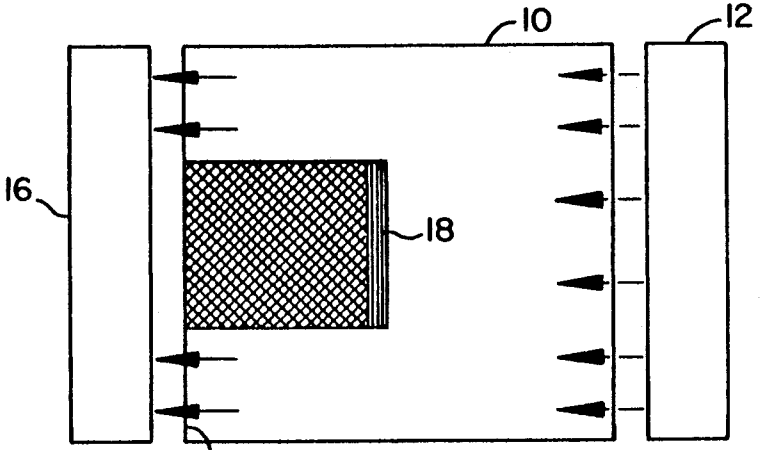
Fig. 1 PRIOR ART
FIG. 1 is an elevational view through an article-containing passageway of a prior art article sensing device including a single light source defining a sensing plane and a single light detector to detect an interruption of the light beam by an article within the passageway.
Figure 5:
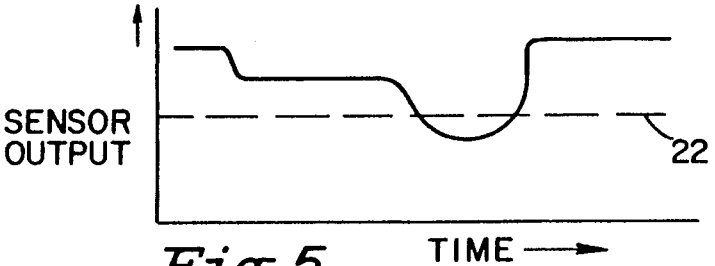
Fig. 5 PRIOR ART
FIG. 5 is a graph showing light sensor output as a function of time as the article oriented relative to the light source as illustrated in FIGS. 1 and 2 passes through the sensing plane.

When article 18 is oriented as shown in FIGS. 1 and 2, the output from sensor 16 as a function of time is a signal of varying magnitude as shown in FIG. 5, corresponding with the variation of the cross-sectional area of the key, and the quantity of light blocked by the key as it passes through the sensing plane when oriented to present its broadest face across the light path. On the other hand, when the key is oriented relative to the light source in the position as shown in FIGS. 3 and 4, the output from sensor 16 as a function of time is a substantially lower magnitude signal, as shown in FIG. 6, corresponding with the constant width of the key.

Figure 6:
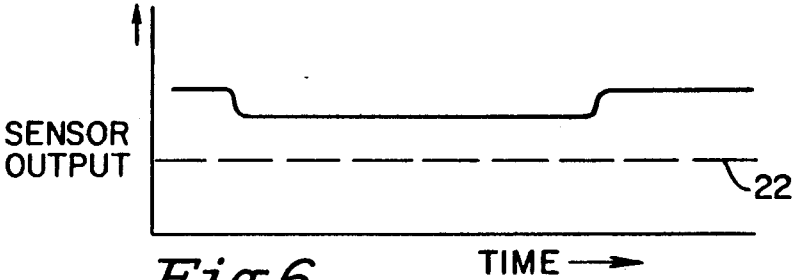
Fig. 6 PRIOR ART
FIG. 6 is a graph similar to FIG. 5 but showing light sensor output as a function of time as the article oriented as illustrated in FIGS. 3 and 4 passes through the sensing plane.

Single light source sensing systems of the type shown in FIGS. 1 through 4 are usually set up to respond to and provide a count signal when the sensor output is below a predetermined base value, such as level 22 as shown in FIG. 6. Therefore, unless the article is properly oriented, such as the orientation shown in FIGS. 1 and 2, it could possibly not be counted, as might be the case for the article orientation shown in FIGS. 3 and 4. An example of a system that utilizes such a threshold value as a determinant in making a count is disclosed in U.S. Pat. No. 4,982,412, which issued Jan. 1, 1991, to Barry M. Gross. In that patent the sensing system also is arranged to provide pulses indicative of the end points of an article, and is also arranged to ignore pulses having a predetermined time length, in order to avoid double counting of a part. However, in that patent the articles to be counted are symmetrical about a longitudinal axis, and therefore their orientation is not critical.

Figure 7:
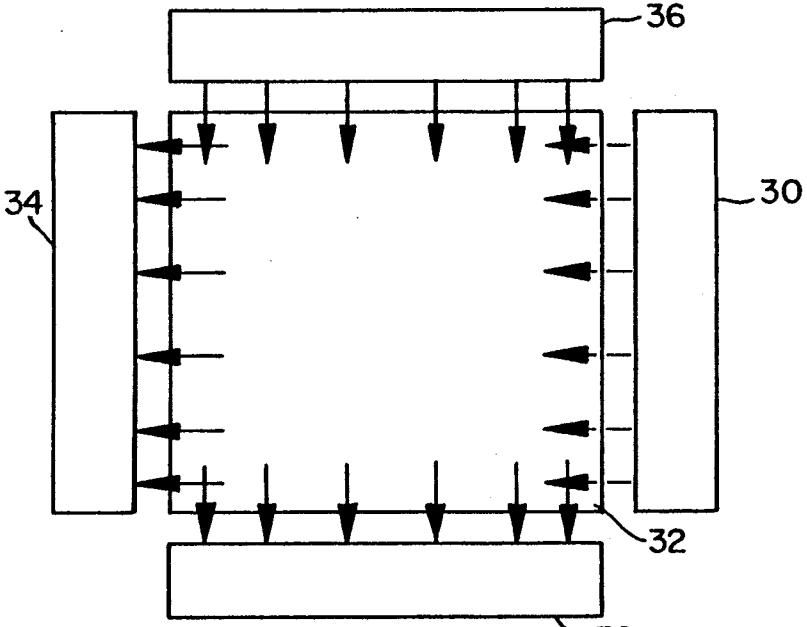
FIG. 7 is an elevational view similar to FIG. 1, but taken at an article sensing plane utilizing a dual light source and dual light sensor arrangement in accordance with the present invention.

In distinct contrast with the prior art devices, the present invention permits the accurate counting of irregularly-shaped articles regardless of their orientation within the sensing plane. In that regard the present invention includes a pair of crossed light beams with associated detectors, as shown in FIG. 7. A first radiant energy source 30 is disposed to emit an elongated first radiant energy beam to extend across a sensing plane 32 in a first direction. First radiant energy source 30 is positioned to cause the first beam to impinge upon and to be received by a first radiant energy detector 34 that is positioned directly across sensing plane 32 from first radiant energy source 30.

A second radiant energy source 36 is disposed at substantially a 90° angle to first radiant energy source 30 to emit a second elongated radiant energy beam to extend across sensing plane 32 in a direction perpendicular to the direction of the first beam. Second radiant energy source 36 is positioned to cause the second beam to impinge upon and to be received by a second radiant energy detector 38. Thus, two crossing radiant energy beams are provided, with the orientation of the sources 30 and 36 being such that the beam emanating from one source preferably does not impinge on the detector associated with the other source.

Figure 8:
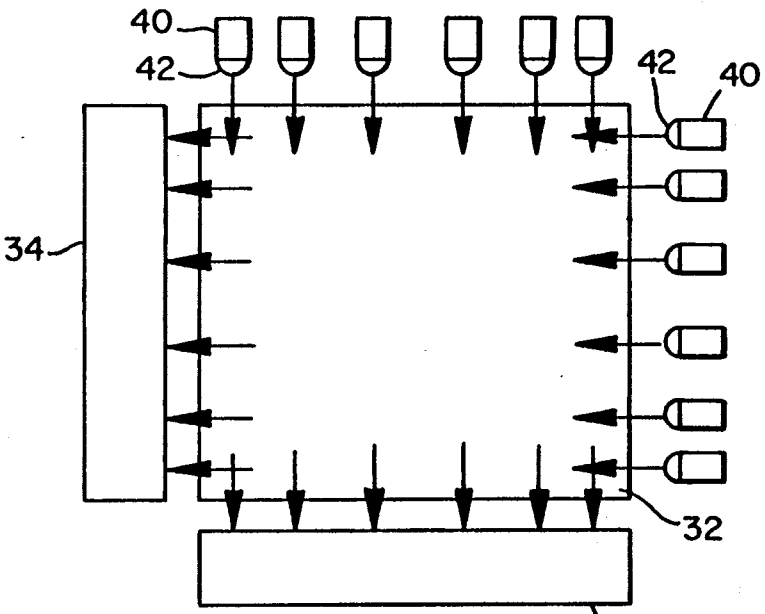
FIG. 8 is a view similar to FIG. 7, showing a series of light emitting diodes as the light sources at the sensing plane.

The respective radiant energy sources can be any of a variety of types, such as a series of light-emitting diodes 40, as shown in FIG. 8, or alternatively, they can be neon tubes, fluorescent tubes, or stroboscopic gas discharge devices, among others that are familiar to those skilled in the art. Hereinafter the beams will be referred to as light beams, although it should be understood that radiant energy sources other than those providing visible light can also be selected to be the sources of the radiant energy beams. Additionally, although referred to herein for convenience as a sensing plane, it will be appreciated that because the light beams emanating from the respective light sources have a finite thickness, in the direction of movement of the articles to be sensed, strictly speaking sensing plane 32 is not a plane of infinitesimal thickness, but is, instead, a prism in the form of a rectangular parallelepiped.

Figure 9:
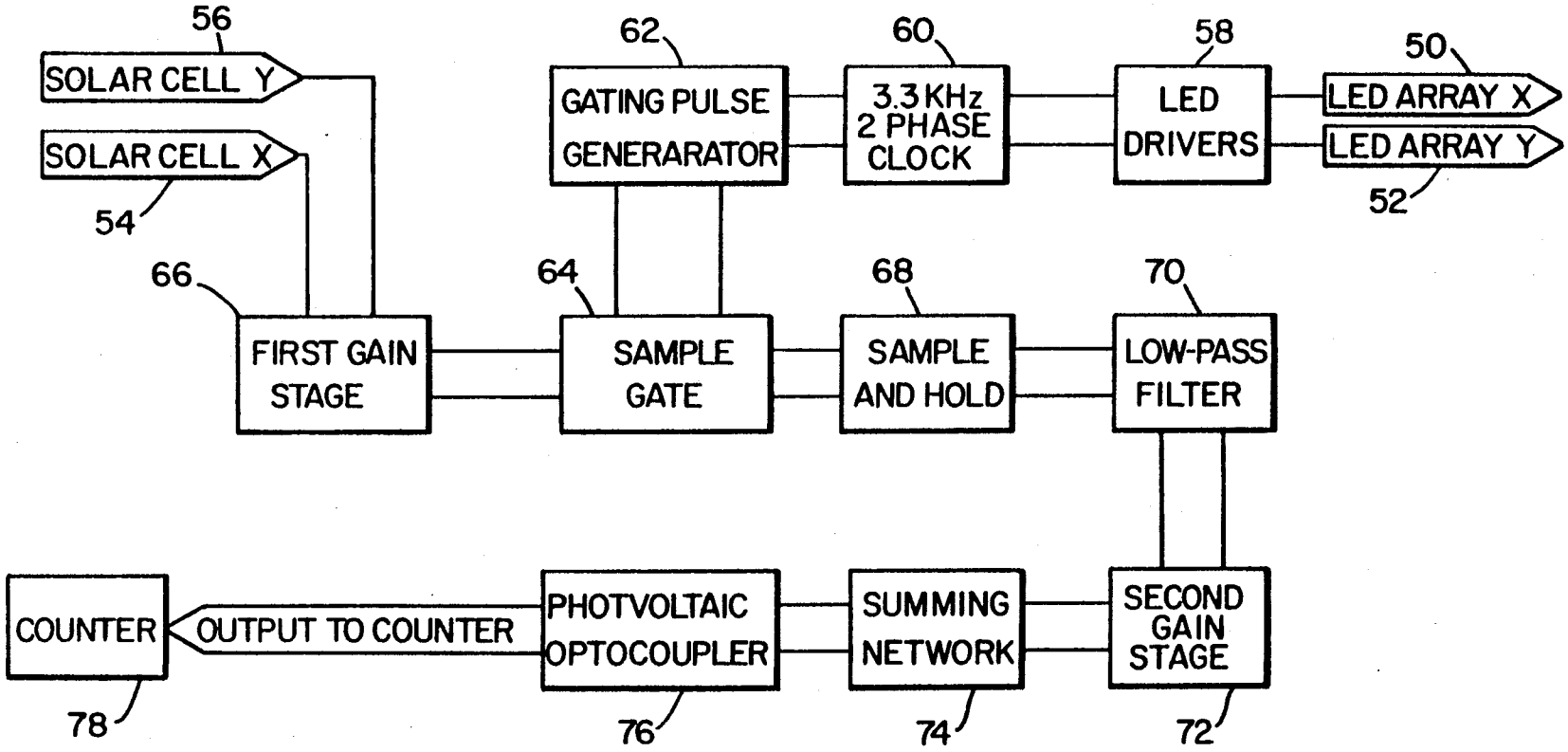
FIG. 9 is a block diagram of an article sensing system in accordance with the present invention.

The structural arrangement shown in FIG. 8 can be employed as part of an article sensing and counting system in accordance with the overall circuit diagram shown in block diagram form in FIG. 9. A first aligned array 50 of individual LED's 40 as shown in FIG. 8 are positioned along one side of the article sensing plane, and a second aligned array 52 of individual LED's 40 is positioned substantially at right angles to first array 50, again as illustrated in FIG. 8.

The light detectors are provided in the form of a pair of solar cells, a first solar cell 54 positioned opposite first array 50 of LED's and a second solar cell 56 positioned opposite second array 52 of LED'S. Each of LED arrays 50 and 52 can be provided by a total of ten LED'S, as shown in FIG. 8, preferably with lenses 42 on each LED to focus the light beams emanating from the respective LED's into narrow cones.

Referring once again to FIG. 9, a clock pulse source 60 is connected with the LED drivers 58 and also with a gating pulse generator 62. The LED arrays are switched so that when array 50 is on, array 52 is off, and vice versa. A sample gate 64 is switched in synchronism with the LED's so that when LED array 50 is in the ON condition solar cell 54 is also switched on, and when LED array 50 is in the OFF condition solar cell 54 is also switched off. Similarly, when LED array 52 is in the ON condition solar cell 56 is also switched on, and when LED array 52 is in the OFF condition solar cell 56 is also switched off. Thus, the method and apparatus in accordance with the present invention operate to prevent light from one light source from influencing the output of the detector associated with the other light source. Another way to prevent one light source from influencing the output of the detector associated with the other light source is to provide light sources that each emit light of a different color, and to provide light detectors that are responsive only to the color of the light emitted by its associated light source.

Figure 7A:
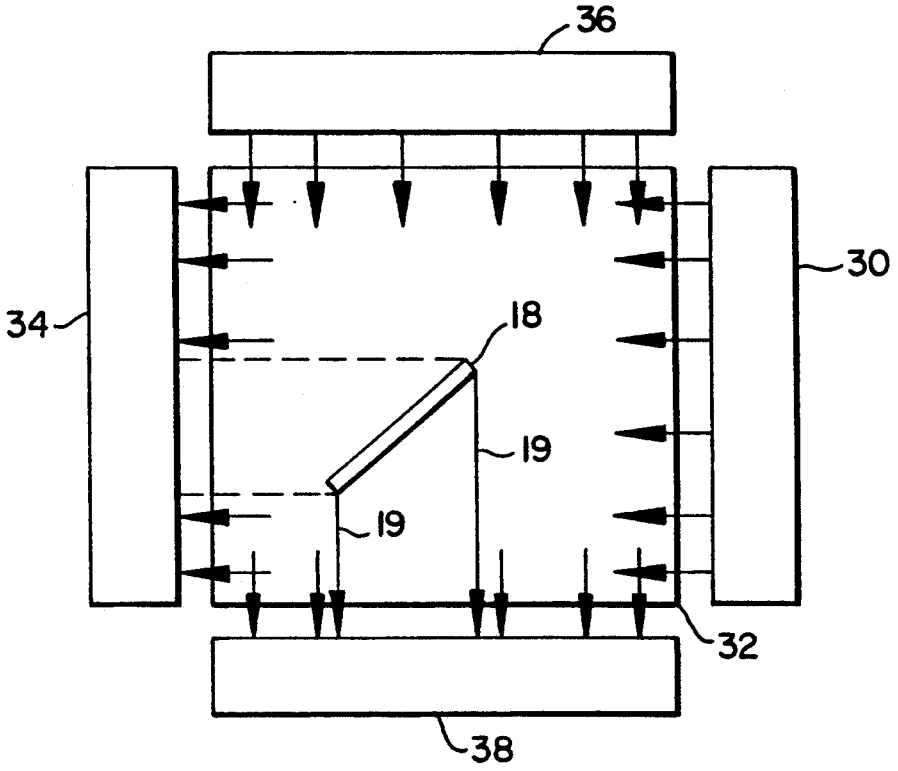
FIG. 7A is an elevational view similar to FIG. 7 showing an article as it passes through the sensing plane of apparatus in accordance with the present invention, the article being shown as having been rotated, relative to the directions of the respective light beams, to a position between those positions of the article that are illustrated in FIGS. 1 and 3 .

When the article, or key 18, is so oriented that a portion of the light from source 30, beans 19, is partially reflected onto detector 38, as shown in FIG. 7A, if both detectors were operative at the same time it would be possible for detector 34 to provide an output signal indicative of the presence of an article, while detector 38 could provide an output signal indicative of the absence of an article, because of the additive effect of the reflected light beams 19. The circuit arrangement of the present invention avoids that confusing result and prevents the reflected portion of the beam from having an effect on the output of detector 38, because the present invention is a time-division multiplex system, and only one source and its associated one detector are operative at any one time.

The outputs from sample gate 64 are fed to a sample and hold circuit 68, then through a low-pass filter 70 to a second gain stage 72, after which the individual, amplified solar cell signals are summed in summing network 74. The output from summing network 74 is fed to a photovoltaic optocoupler 76, which transmits a signal to a counter 78.

Figure 10:
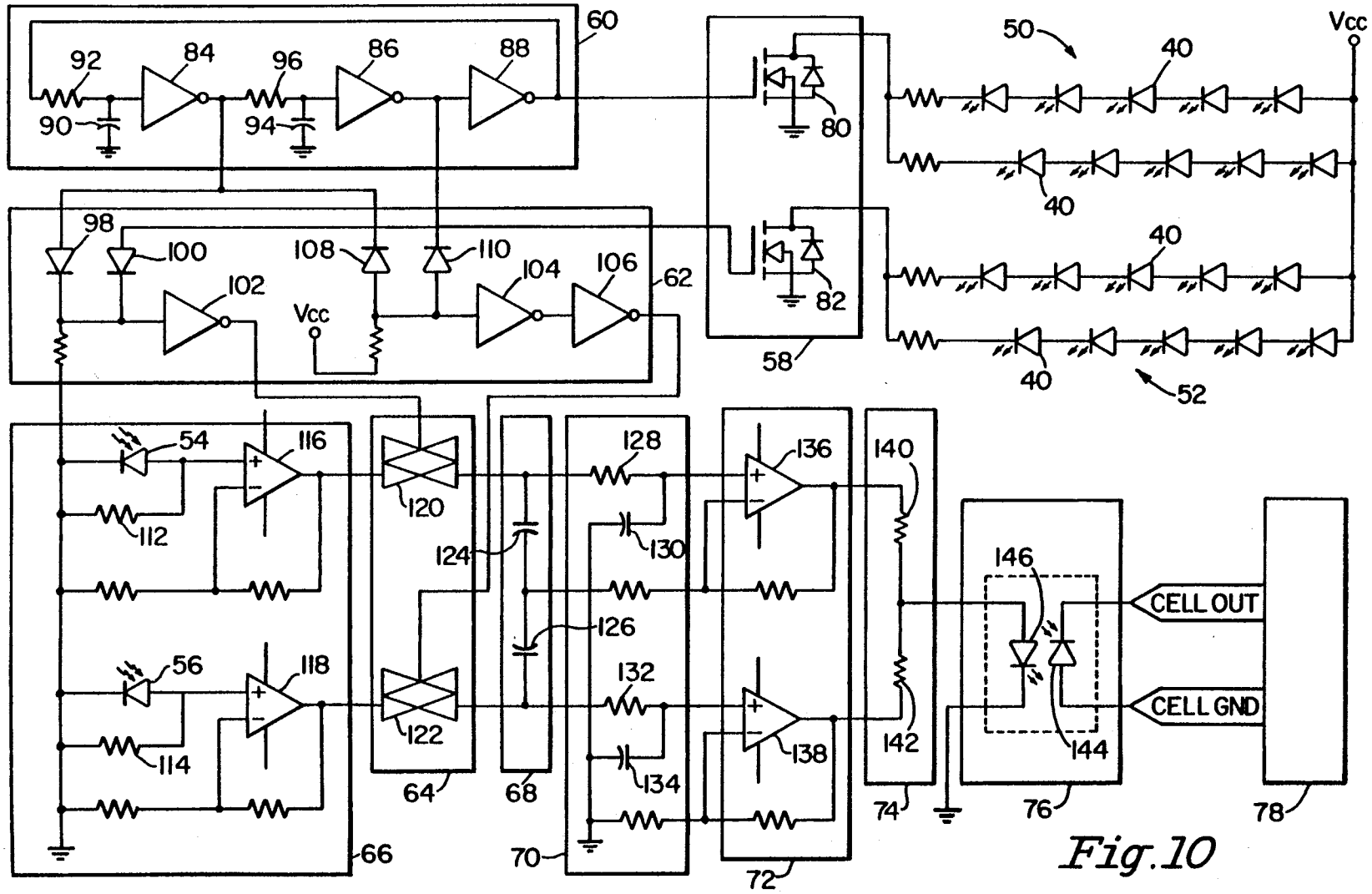
FIG. 10 is a circuit diagram corresponding with the block diagram shown in FIG. 9.

A circuit that can be employed to prove the several functions shown in the block diagram of FIG. 9 is shown in FIG. 10. The disclosed arrangement includes a relaxation oscillator that is so configured as to provide a time division multiplex system. Thus, the LED arrays are respectively energized during successive time intervals, and any light emitted from one array is not sensed by the detector associated with the other array.

As a result of summing the two signals from the respective detectors, the orientation relative to a single light beam of the article to be sensed is therefore not as critical because the sum of the outputs of the separate groups of detectors will be sufficiently large to provide a signal to sense the presence of the article.

In operation, and referring to FIGS. 9 and 10, LED arrays 50 and 52 are driven by respective LED drivers, provided in the form of switching transistors 80 and 82. The time base is provided by a relaxation oscillator that includes logical inverters 84, 86, and 88, and is essentially a hex inverter integrated circuit with schmitt trigger inputs.

Operation of the time base is as follows: assume a rising edge at the output of amplifier 88, which will begin charging capacitor 90 through resistor 92. Capacitor 90 will reach the switching threshold of the input pin of amplifier 84 in approximately 110 microseconds. The output of amplifier 84 will fall, beginning discharge of capacitor 94 through resistor 96 to a level below the switching threshold of amplifier 86 in approximately 40 microseconds. The output from amplifier 86 will rise, as a result of which the output from amplifier 88 will fall.

Capacitor 90 will then discharge through resistor 92, and when capacitor 90 reaches the switching threshold of amplifier 84 in approximately 110 microseconds, the output of amplifier 84 will rise. Capacitor 94 will then charge through resistor 96 and when capacitor 94 reaches the switching threshold of amplifier 86 in approximately 40 microseconds the output of amplifier 86 will fall causing the output of amplifier 88 to rise. This completes the cycle. The total time to complete the cycle is approximately 300 microseconds and therefore the sampled system operates at 3.3 Khz.

At the time when the outputs of amplifiers 84 and 86 are both low, diodes 98 and 100 allow the input to amplifier 102 to go low and the output to go high. This is the sampling pulse for solar cell 54. At the time when the outputs of amplifiers 84 and 86 are both high, diodes 108 and 110 allow a high at the input of amplifier 104, which is inverted twice to produce a high at the output of amplifier 106, which is the sampling pulse for solar cell 56.

Amplifier 88 drives switching transistor 80, turning LED array 50 on and off; amplifier 86 drives switching transistor 82 turning LED array 52 off and on.

A delay time is allowed each time an LED array is turned on, to allow the detector to charge its own internal capacitance and to settle to a constant value. A sampling pulse is then generated. Two sampling pulses are provided, one for each of LED arrays 50 and 52, and those sampling pulses are produced by inverters 102, 104, and 109, and the associated diode networks including diodes 98, 100, 108, and 110.

Each solar cell detector 54, 56 is loaded by resistors 112, 114, respectively, and the currents produced by those solar cells are low enough that the terminal voltage is low. Substantially all the current flows through the associated load resistor, and none of it is lost as forward conduction current in the solar cell itself. Thus the output voltage is a linear function of the light striking the cell. Additionally, the low value of load resistance lowers the settling time of the solar detectors in response to switching the LED arrays on and off. Resistor 114 is preferably of a lower resistance value than that of resistor 112 because the sensing aperture is rectangular, not square, and LED array 50 is physically closer to solar cell 54 than is LED array 52 to solar cell 56. This serves to balance the sensitivity of the two channels.

Amplifiers 116 and 118 are connected as positive gain, high input impedance amplifiers, with a voltage gain of approximately 30, and are type LM 324, which allow the common mode input voltage to drop to the level of the negative supply. Therefore, in the disclosed arrangement the negative supply voltage is at ground potential.

Sample gate 64 includes symmetric FET switches 120, 122, each of which has an impedance of about 90 ohms in the ON state, and essentially infinite impedance in the OFF state. Their function is to operate with respective capacitors 124 and 126 to sample and hold the amplified voltages from respective solar cells 54 and 56 at the levels at the outputs of amplifiers 116 and 118 so that a voltage representing the light level is continuously available for summing network 74. When solar cell 54 been illuminated for 110 microseconds, its output has stabilized and the amplified signal at the output of amplifier 116 has also stabilized. At that time the gating signal provided by the output of amplifier 102 goes high and turns on switch 120 for 40 micro seconds. Capacitor 124 is charged or discharged as needed to assume the voltage at the output of amplifier 116. Switch 120 then is turned OFF, and capacitor 124 holds its charge until the next time switch 120 goes ON.

In a similar manner, the output signal from solar cell 56 is amplified by amplifier 118 and is switched onto capacitor 126 by switch 122.

The respective signals from sample and hold circuit 68 then are conducted to low pass filter 70, which includes two single pole, low pass networks the first of which includes resistor 128 and capacitor 130 and the second of which includes resistor 132 and capacitor 134, and operate to remove the sampling discontinuities from the wave forms that exist on capacitors 124 and 126.

After passing through low pass filter 70 the signals enter second gain stage 72, which include amplifiers 136 and 138 that serve as high input impedance buffers with a gain of approximately 5. Amplifiers 136 and 138 also serve to eliminate the loading on capacitors 124 and 126, respectively, so that there is no droop between sample times. The outputs from second gain stage 72 are summed in summing network 74, which includes summing resistors 140 and 142. Their sum is the current entering optocoupler 76.

The system herein described is intended to directly replace a single channel detector with a photovoltaic cell detector, in the form of optocoupler 76, which has a small photovoltaic cell 144 that is illuminated by LED 146 placed adjacent to it. The currents from resistors 140 and 142 operate LED 146.

The outputs of the several detectors are to be combined in a way to produce no ambiguity as to the presence of an object within the beams at the sampling plane. The impulses from optocoupler 76 may be combined into one by simply adding them together, or they can be received in a counting circuit 78 of a type familiar to those skilled in the art.

Figure 11:
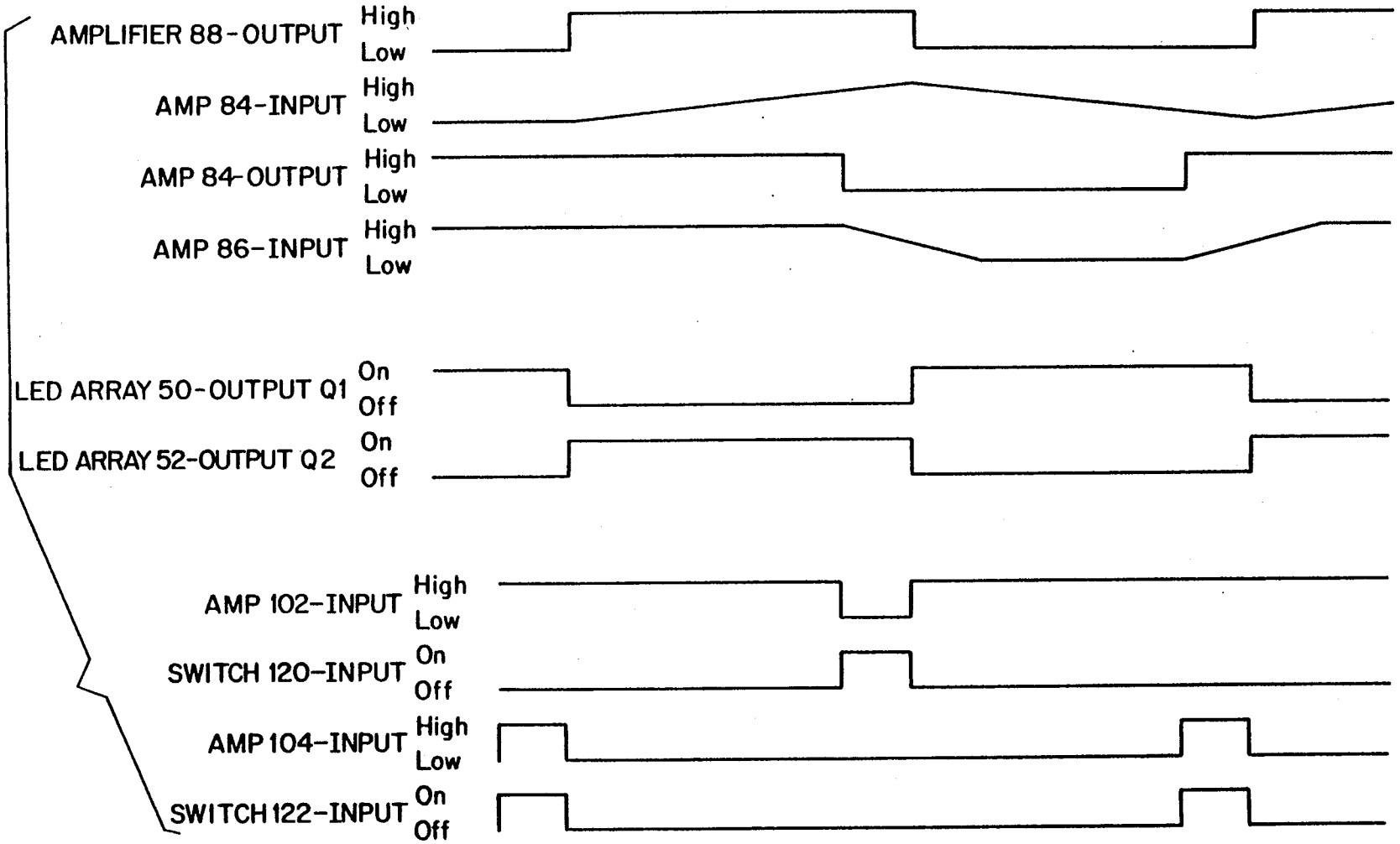
FIG. 11 is a timing diagram showing the relative operating states of the several elements shown in FIG. 10.

Referring to FIG. 11, there is shown a timing diagram of the respective signals at various points in the circuit of FIG. 10.

The present invention permits the accurate detection and counting of irregularly or unsymmetrically shaped articles, such as articles in the form of the key blanks shown in FIGS. 1 through 4. When a key blank is edge-on to one beam, it is broadside to the other, and vice versa, and the combination of the individual signals from the respective solar cells allows the count to be accurate, thereby reducing the loss from failing to count all articles.

Although particular embodiments of the present invention have been illustrated and described, it will be apparent to those skilled in the art that various changes and modifications can be made without departing from the spirit of the present invention. It is therefore intended to encompass within the appended claims all such changes and modifications that fall within scope of the present invention.

What is claimed is:

1. A method of detecting and counting articles of arbitrary size, shape, and orientation that travel along a passageway, said method comprising:

a. providing first and second light sources, each light source providing an elongated light beam that extends across a passageway through which pass articles to be detected and counted, the light sources each oriented to provide a respective light beam that extends across the passageway at an angle to the other light beam to define a sensing plane within the passageway;

b. providing first and second light detectors, each detector spaced from, positioned opposite to and adapted to receive light from a respective one of the first and second light sources to provide an individual output signal representative of the amount of light reaching the respective detector when an article to be counted passes through the light beam;

c. operating the first and second light sources alternately so that only one of the first and second light sources is operative at a given time;

d. alternately sensing the quantity of light that impinges upon the respective light detectors as an article passes through the sensing plane defined by the respective light beams and providing an output signal from each light detector that is representative of the quantity of light impinging on the respective detector;

e. adding together the individual output signals form the respective detectors to provide a combined detector output signal;

f. counting successive combined output signals that differ in a predetermined magnitude form a predetermined combined detector output signal level to provide a count of the number of articles passing the first and second light detectors in the passageway.

2. A method in accordance with claim 1, wherein the light sources are oriented so that the axes of the light beams are at an angle of about 90° relative to each other.

3. A method in accordance with claim 1, wherein the articles to be detected and counted are unsymmetrical about at least one axis.

4. A method in accordance with claim 1, wherein the light sources are each operated to provide intermittent pulses of light, and the detectors are adapted to provide output signals only during the times the associated light sources are operative.

5. A method in accordance with claim 1, wherein each light source includes a plurality of individual light sources that collectively provide a plurality of light beams.

6. Apparatus for detecting and counting articles of arbitrary size, shape, and orientation, said apparatus comprising:

a. a passageway for receiving articles to be counted;

b. first and second light sources positioned adjacent to the passageway and oriented to provide respective elongated, crossing light beams that each extend across the passageway at an angle to each other to define a sensing plane;

c. first and second light detectors positioned adjacent to the passageway, each detector spaced from and positioned opposite a respective light source to provide an individual output signal representative of a change in the amount of light reaching the respective detectors when an article to be counted is in the sensing plane;

d. a time division multiplex circuit coupled with the light sources and with the light detectors for alternately energizing the respective first and second light sources and for alternately sensing the quantity of light that impinges upon the respective first and second detectors from the respective first and second opposed light sources as an article passes through the sensing plane;

e. a summing circuit for receiving and adding together the individual output signals form the respective first and second detectors to provide a combined detector output signal; and f. a counter for counting successive combined output signals that differ in a predetermined magnitude from a predetermined combined output signal level to provide a count of the number of articles passing the light detectors in the passageway.

7. Apparatus as claimed in claim 6 wherein the time division multiplex circuit includes a gating pulse generator coupled with the light sources for regulating the times during which each of the light sources is emitting light, and a sample gate coupled with the gating pulse generator and with the light detectors for synchronizing light detector ON and OFF states with On and OFF states of the light sources associated with the respective detectors.

8. Apparatus in accordance with claim 6, including an optocoupler connected between the summing circuit and the counter for receiving a summation signal from the summing circuit and for conveying the summation signal to the counter.

* * * * *